US007988431B2

(12) United States Patent
Byun et al.

(10) Patent No.: US 7,988,431 B2
(45) Date of Patent: Aug. 2, 2011

(54) CAPACITY-VARIABLE ROTARY COMPRESSOR

(75) Inventors: Sang Myung Byun, Gyeongsangnam-Do (KR); Jeong Min Han, Gyeongsangnam-Do (KR); Jeong Hun Kim, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 789 days.

(21) Appl. No.: 11/839,649

(22) Filed: Aug. 16, 2007

(65) Prior Publication Data

US 2009/0155112 A1 Jun. 18, 2009

Related U.S. Application Data

(60) Provisional application No. 60/908,034, filed on Mar. 26, 2007.

(30) Foreign Application Priority Data

Nov. 20, 2006 (KR) ..... 10-2006-0114770

(51) Int. Cl.
*F03C 4/00* (2006.01)
*F04C 2/00* (2006.01)
*F04C 14/18* (2006.01)

(52) U.S. Cl. ..... 418/23; 418/11; 418/60; 417/286; 417/410.3

(58) Field of Classification Search ..... 418/11, 418/23–30, 60, 63, 100, 270; 417/286, 295, 417/410, 441, 410.3
See application file for complete search history.

(56) References Cited

U.S. PATENT DOCUMENTS

| | | | |
|---|---|---|---|
| 5,775,120 | A | 7/1998 | Inazuka et al. |
| 5,775,123 | A | 7/1998 | Wakayama et al. |
| 5,947,373 | A | 9/1999 | Saito et al. |
| 6,182,460 | B1 | 2/2001 | Hernandez et al. |
| 6,374,492 | B1 | 4/2002 | Myung et al. |
| 6,412,298 | B2 | 7/2002 | Kang et al. |
| 6,588,228 | B2 | 7/2003 | Choi |
| 6,772,601 | B1 | 8/2004 | Davis et al. |
| 6,868,681 | B2 | 3/2005 | Woo et al. |

(Continued)

FOREIGN PATENT DOCUMENTS

JP 58-077183 U * 5/1983

(Continued)

OTHER PUBLICATIONS

Japanese Office Action dated Mar. 5, 2010 for Application No. 2007-192917. Chinese Office Action dated Feb. 27, 2009.

*Primary Examiner* — Theresa Trieu
(74) *Attorney, Agent, or Firm* — Ked & Associates LLP

(57) ABSTRACT

A variable capacity rotary compressor is provided, in which a vane may be restricted by a pressure difference generated between both side surfaces of the vane when the compressor performs in a saving driving mode. The vane may be restricted quickly and stably by rapidly decreasing a pressure of a vane chamber by leaking a discharge pressure of the vane chamber to an inlet via a low pressure passage and thereby increasing a pressurizing force applied to a side surface of the vane relatively greater than a supporting force applied to a rear surface thereof. In this way, the vane may be prevented from being vibrated due to a weak restriction force of the vane when a power driving mode of the compressor is switched into the saving driving mode, which prevents noise from increasing due to design conditions, thereby enhancing a comfort feeling of a user.

55 Claims, 9 Drawing Sheets

U.S. PATENT DOCUMENTS

| | | | |
|---|---|---|---|
| 6,955,064 | B2 | 10/2005 | Lee et al. |
| 6,962,058 | B2 | 11/2005 | Kim et al. |
| 7,032,404 | B2 | 4/2006 | Kim et al. |
| 7,036,331 | B2 | 5/2006 | Kim |
| 7,055,338 | B2 | 6/2006 | Ergarac et al. |
| 7,082,776 | B2 | 8/2006 | Shin |
| 7,114,345 | B2 | 10/2006 | Kim et al. |
| 7,121,106 | B2 | 10/2006 | Jung et al. |

FOREIGN PATENT DOCUMENTS

| | | | | | |
|---|---|---|---|---|---|
| JP | 62-265484 | | | 11/1987 | |
| JP | 01080790 | A | * | 3/1989 | ..... 418/23 |
| KR | 10-2006-0014845 | | | 2/2006 | |
| KR | 10-2005-00595766 | | | 6/2006 | |
| WO | WO 2005/061901 | A1 | | 7/2005 | |

* cited by examiner

CAPACITY-VARIABLE ROTARY COMPRESSOR

The present application claims priority to Korean Application No. 10-2006-0114770 filed in Korea on Nov. 20, 2006 and to U.S. Provisional Patent Application Ser. No. 60/908,034 filed in the United States on Mar. 26, 2007, both of which are herein incorporated by reference in their entirety.

BACKGROUND

1. Field

A variable capacity rotary compressor is disclosed herein.

2. Background

Variable capacity rotary compressors are known. However, they have various disadvantages, in particularly when changing operational modes.

BRIEF DESCRIPTION OF THE DRAWINGS

Embodiments will be described in detail with reference to the following drawings in which like reference numerals refer to like elements, and wherein.

DETAILED DESCRIPTION

Figure 1:
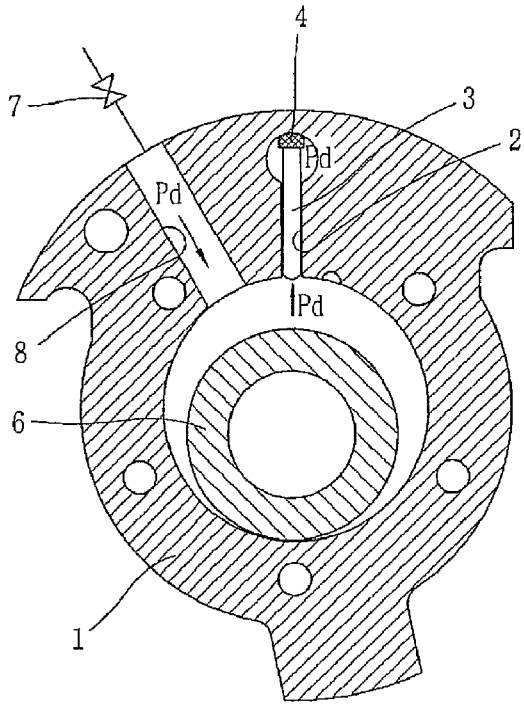
FIG. 1 is a horizontal sectional view of a variable capacity rotary compressor according to an embodiment.

Embodiments will now be described in detail, with reference to the accompanying drawings. Whenever possible like reference numerals have been used for like elements, and duplicative disclosure omitted.

In general, a variable capacity rotary compressor is implemented such that a cooling capacity may be varied (for example, increased or decreased) according to environmental conditions so as to optimize an input-to-output ratio. One recent method utilizes an inverter motor adapted to a compressor to vary the cooling capacity of the compressor. However, in adapting the inverter motor to the compressor, the fabrication cost of the compressor is increased due to the high price of the inverter motor, thereby decreasing price competitiveness of the compressor. Thus, instead of adapting the inverter motor to the compressor, a technique is widely being researched, in which a refrigerant compressed in a cylinder of a compressor is partially bypassed to the exterior so as to vary a capacity of a compression chamber. However, this technique requires a complicated piping system to bypass the refrigerant out of the cylinder. Accordingly, a flow resistance of the refrigerant increases, thereby decreasing efficiency. As such, a method has been proposed, by which the piping system may be simplified without using the inverter motor and the compressor capacity may be varied.

One (first) method allows pressure in an inner space at a cylinder to be changed or varied to a suction pressure or a discharge pressure. Accordingly, at a time of a power driving mode, the suction pressure is applied to the inner space of the cylinder and a vane normally performs a sliding motion, thereby forming a compression chamber. Conversely, at a time of a saving driving mode, the discharge pressure is applied to the inner space of the cylinder and the vane is retreated, thereby not forming the compression chamber (hereinafter this method will be referred to as "first variable capacity method").

Another (second) method is implemented such that a refrigerant of a suction pressure is only applied via an inlet and the suction pressure and the discharge pressure are alternately applied to a rear side of the vane. Accordingly, upon a power driving mode, the vane normally performs a sliding motion, thereby forming a compression chamber. Conversely, upon a saving driving mode, the vane is retreated, thereby not forming the compression chamber (hereinafter this method will be referred to as "second variable capacity method").

However, the two aforementioned methods must continuously restrict the vane, especially in a saving driving mode, in order to stabilize the system. Accordingly, vane restricting devices that restrict the vane must be utilized.

Figure 2:
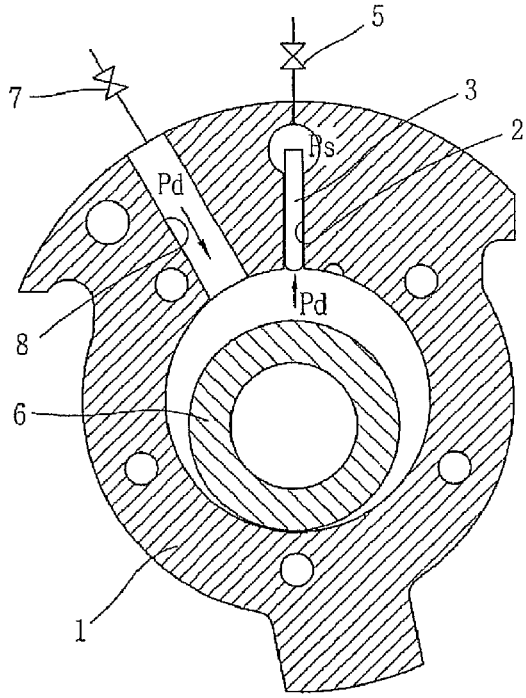
FIG. 2 is a horizontal sectional view of another variable capacity rotary compressor according to an embodiment.

For example, regarding the first variable capacity method, as shown in FIG. 1, a magnet 4 is provided at a rear side of a vane 3 disposed in a vane slot 2 of a cylinder 1, or, as shown in FIG. 2, a back pressure switching valve 5 that supplies suction pressure is provided at the rear side of the vane 3. Accordingly, the vane 3 is maintained in a retreated state. Reference numeral 6 denotes a rolling piston, 7 denotes a mode switching valve, and 8 denotes an inlet.

Figure 3:
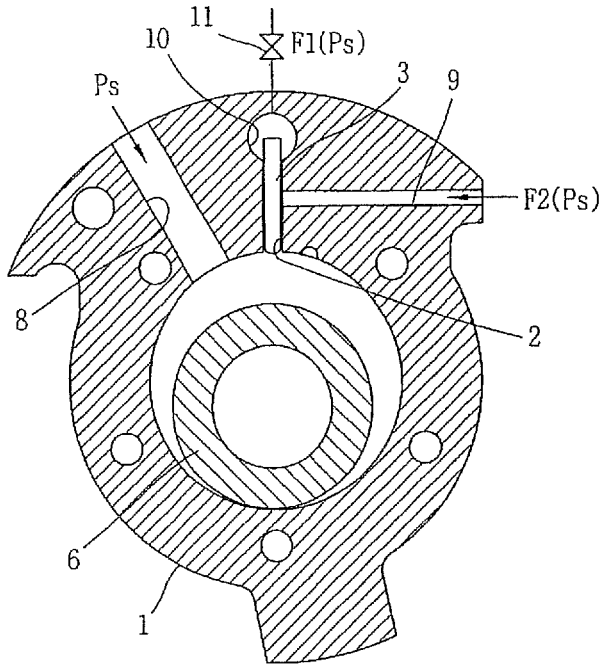
FIG. 3 is a horizontal sectional view of another variable capacity rotary compressor according to the an embodiment.

In addition, regarding the second variable capacity method, as shown in FIG. 3, a lateral pressure passage 9 is disposed in the cylinder 1 to restrict the vane 3 by supplying a discharge pressure toward a lateral surface of the vane 3. Reference numeral 10 denotes a vane chamber, and 11 denotes a back pressure switching valve.

Figure 4:
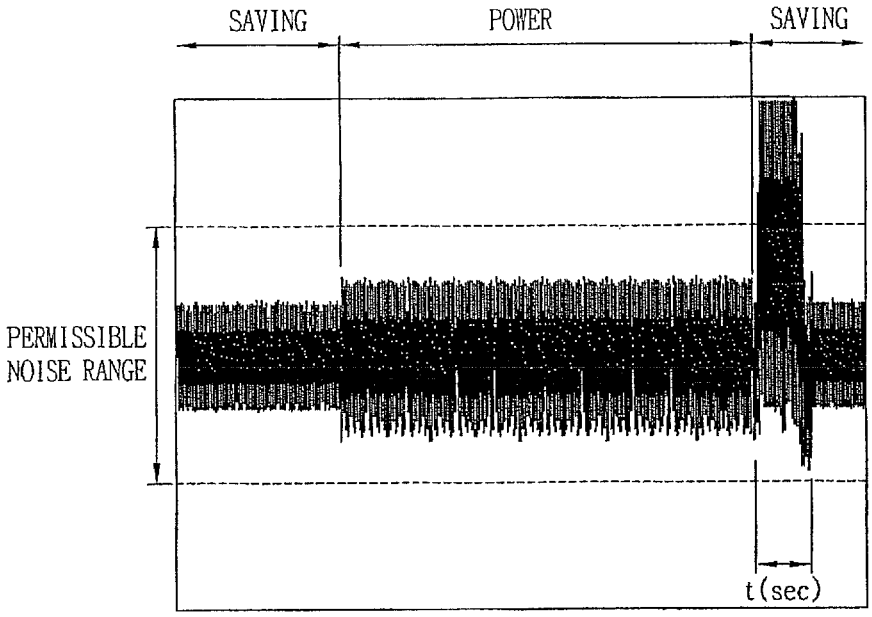
FIG. 4 is a graph showing noise characteristics at a time of switching a mode of the variable capacity rotary compressor of FIG. 3.

However, such vane restricting devices can not restrict the vane 3 at the same time when the operation mode of the compressor is switched, thereby lowering the performance of the compressor. In particular, vibration noise is generated by the vane 3, which greatly increases compressor noise. For example, in the method of FIG. 1, in order to smoothly perform the compressor mode switching, large magnetism of the magnet 4 can not be applied. As a result, upon the saving driving mode of the compressor, the magnet 4 can not rapidly restrict the vane 3, and thereby noise can be generated due to vane jumping. In the method of FIG. 2, on the other hand, upon the power driving mode of the compressor, a pressure at the rear side of the vane 3 can not rapidly be varied from a discharge pressure into a suction pressure, and thereby the vane 3 is not restricted at the same time of the mode switching. As a result, noise may be generated due to an impact between the rolling piston 6 and the vane 3. Also, in the method of FIG. 3, a lateral force F2 transferred to the vane 3 via the lateral pressure passage 9 is not sufficiently greater than a force F1 due to pressure in the vane chamber 10. Also, a pressure at the rear side of the vane 3 can not rapidly be varied from a discharge pressure into a suction pressure, and thereby the vane 3 is not restricted at the same time when the compressor mode switching. As a result, an impact occurs between the vane 3 and the rolling piston 6, which makes noise. In particular, under a particular driving condition of the compressor, as shown in FIG. 4, when the compressor is switched from a power driving mode into a saving driving mode, excessive noise is generated for a certain time period t.

Typically, rotary compressors may be classified into single type rotary compressors or double type rotary compressors according to a number of cylinders. For example, for a single type rotary compressor, one compression chamber is formed using a rotational force transferred from a motor. For a double type rotary compressor, a plurality of compression chambers having a phase difference of 180° therebetween are vertically formed, using a rotational force transferred from a motor. Hereinafter, explanation is given of a double type variable capacity rotary compressor in which a plurality of compression chambers are vertically formed, and a capacity of at least one of the compression chambers is varied. That is, a variable capacity double type rotary compressor according to an embodiment will be explained in detail with reference to the accompanying drawings.

Figure 5:
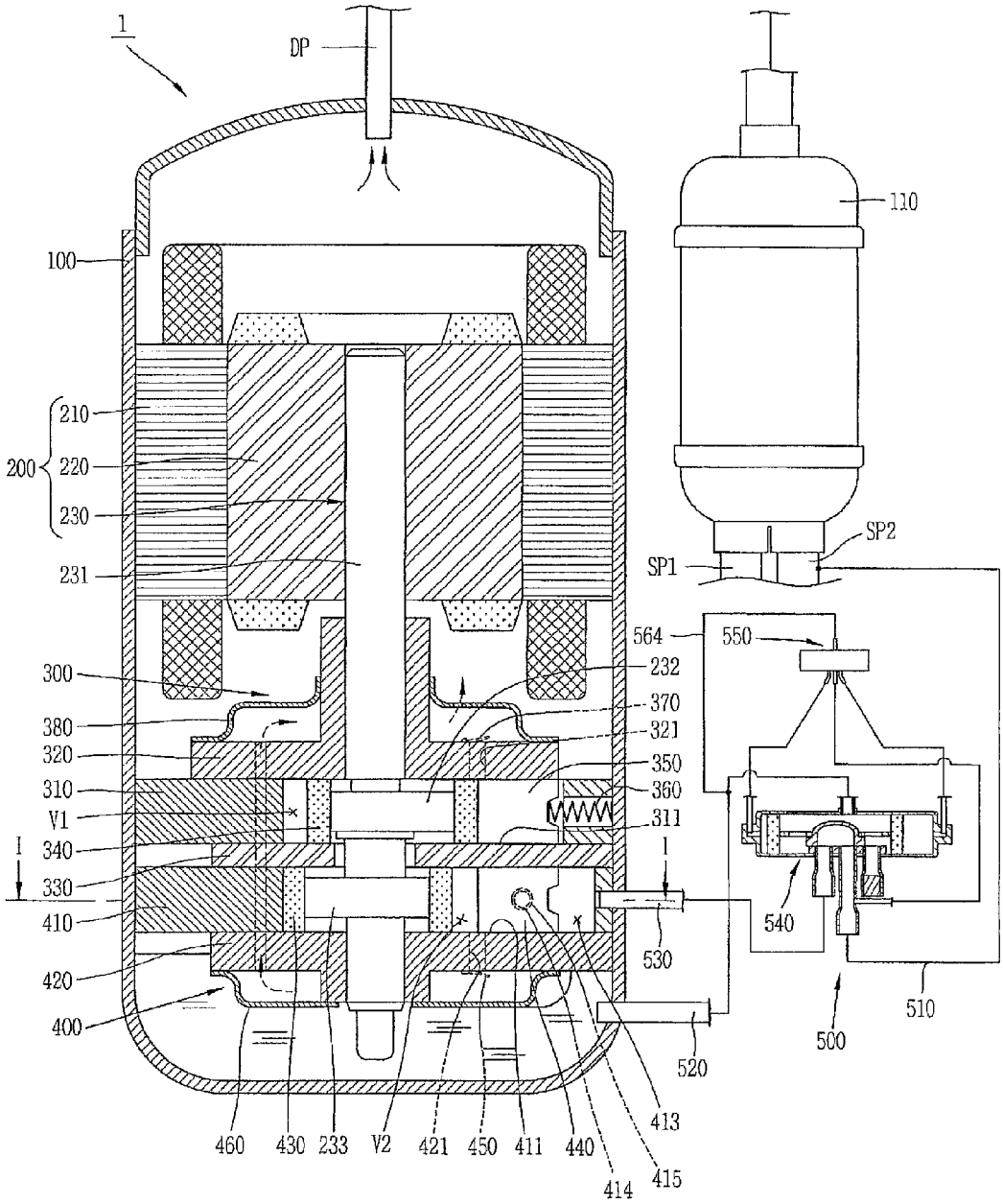
FIG. 5 is a longitudinal sectional view of a variable capacity rotary compressor according to an embodiment.
Figure 6:
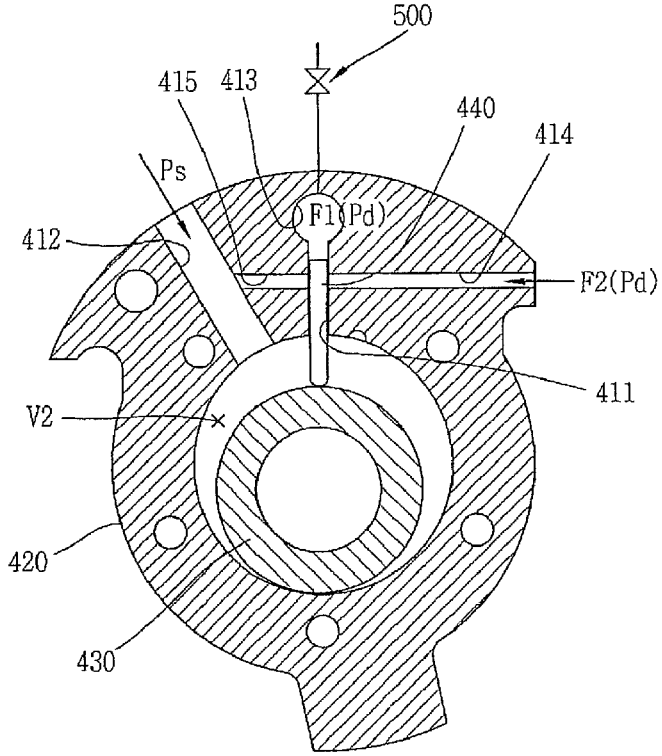
FIG. 6 is a horizontal sectional view showing a released state of a vane when the variable capacity rotary compressor of FIG. 5 is in a power driving mode according to an embodiment.
Figure 7:
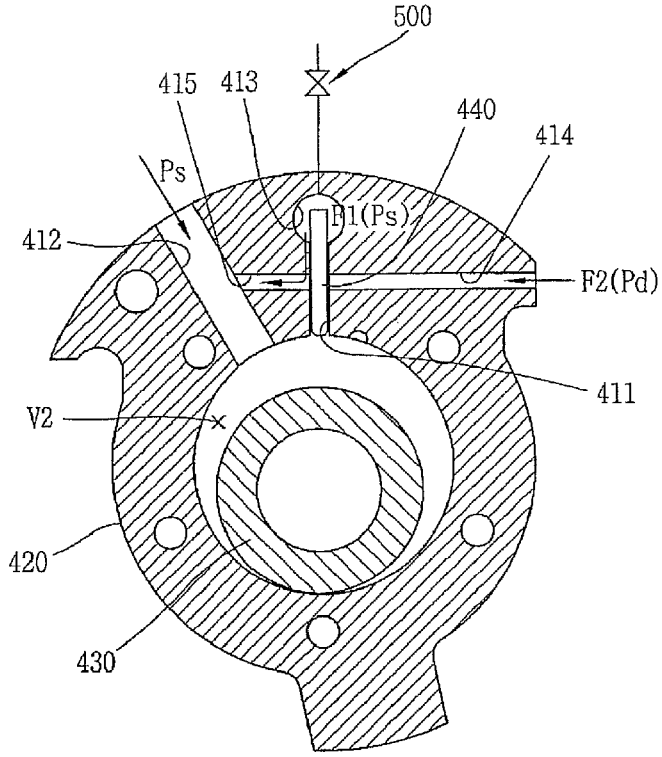
FIG. 7 is a horizontal sectional view showing a restricted state of a vane when the variable capacity rotary compressor of FIG. 5 is in a saving driving mode.
Figure 8:
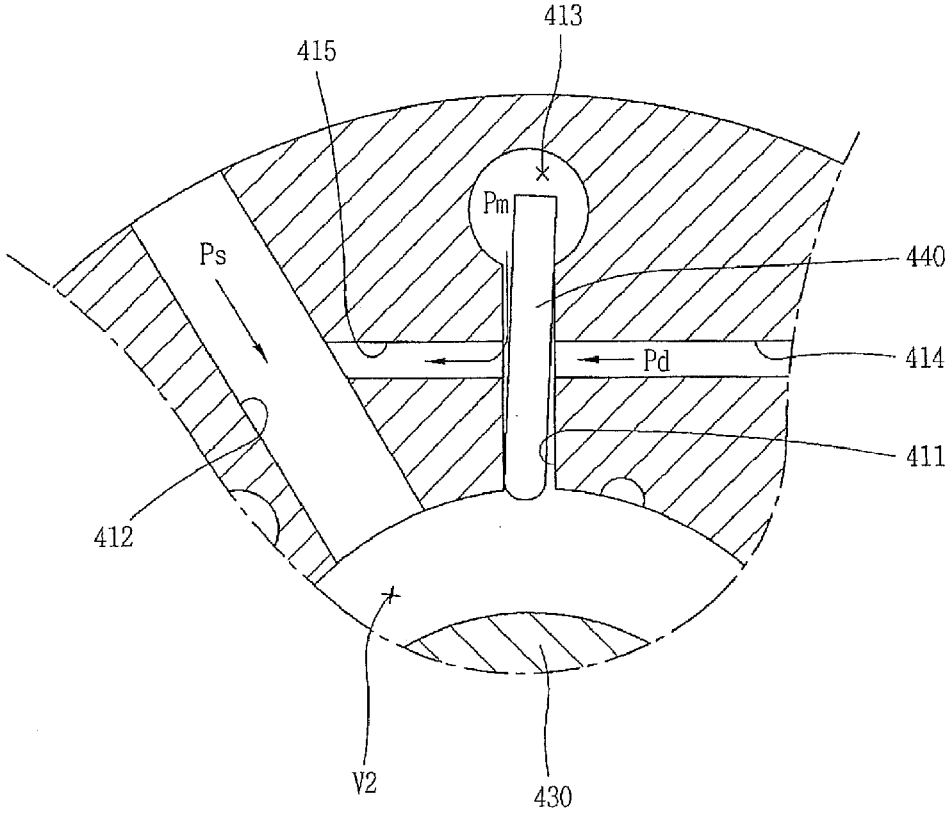
FIG. 8 is an enlarged view showing in detail a process of restricting the vane of FIG. 7.
Figure 9:
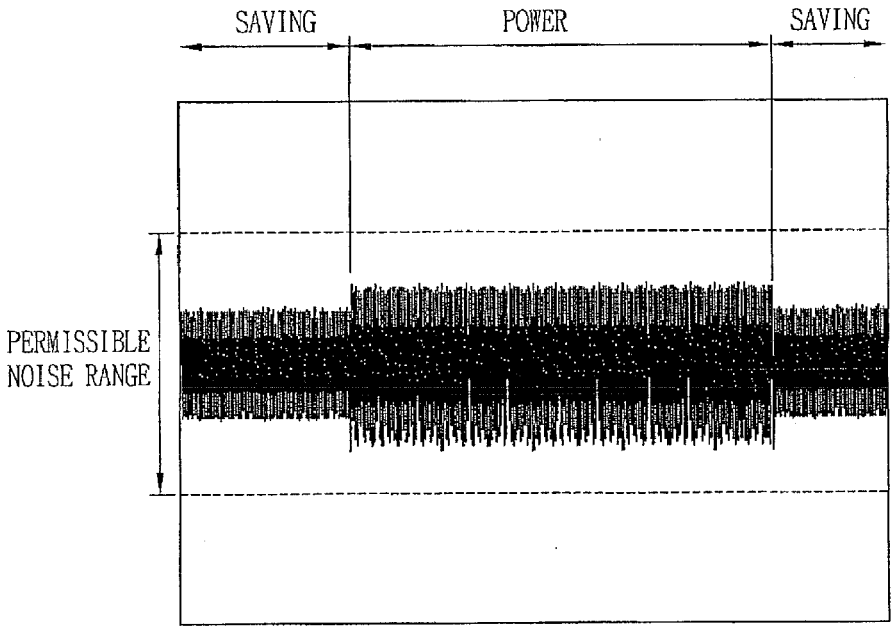
FIG. 9 is a graph showing noise characteristics at a time of switching a mode of the variable capacity rotary compressor of FIG. 5.

FIG. 5 is a longitudinal sectional view of a variable capacity rotary compressor according to an embodiment. FIG. 6 is a horizontal sectional view showing a released state of a vane when the variable capacity rotary compressor of FIG. 5 is in a power driving mode. FIG. 7 is a horizontal sectional view showing a restricted state of a vane when the variable capacity rotary compressor of FIG. 5 is in a saving driving mode. FIG. 8 is an enlarged view showing in detail a process of restricting the vane of FIG. 7. FIG. 9 is a graph showing noise characteristics at a time of a mode change of the variable capacity rotary compressor of FIG. 5.

As shown in FIG. 5, a double type variable capacity rotary compressor 1 according to an embodiment may include a casing 100 having a hermetic space, a motor 200 which may be installed at an upper side of the casing 100 and that generates a constant speed rotational force or an inverter rotational force, a first compression device 300 and a second compression device 400 which may each be disposed at a lower side of the casing 100 and that compress the refrigerant by a rotational force generated from the motor 200, and a mode switching device 500 that switches an operation mode such that the second compression device 400 performs a power driving mode or a saving driving mode.

The hermetic space of the casing 100 may be maintained in a discharge pressure atmosphere by the refrigerant discharged from the first compression device 300 and the second compression device 400. A first gas suction pipe SP1 and a second gas suction pipe SP2 may be respectively connected to a lower circumferential surface of the casing 100 so as to allow the refrigerant to be sucked into the first and second compression parts 300 and 400. A gas discharge pipe DP may be connected to an upper end of the casing 100 such that the refrigerant discharged from the first and second compression devices 300 and 400 to the hermetic space may be transferred to a refrigeration system.

The motor 200 may include a stator 210 which may be installed in the casing 100 and that receives power from the exterior, a rotor 220 disposed in the stator 210 with a certain air gap therebetween and rotated by interaction with the stator 210, and a rotational shaft 230 coupled to the rotor 220 that transmits the rotational force to the first compression device 300 and the second compression device 400.

The rotational shaft 230 may include a shaft portion 231 coupled to the rotor 220, and a first eccentric portion 232 and a second eccentric portion 233 eccentrically disposed at both right and left sides below the shaft portion 231. The first and second eccentric portions 232 and 233 may be symmetrically disposed by a phase difference of about 180° therebetween. The first and second eccentric portions 232 and 233 may be respectively rotatably coupled to a first rolling piston 340 and a second tolling piston 430 which will be explained later.

The first compression device 300 and the second compression device 400 may be arranged at upper and lower sides of a lower portion of the casing 100. The second compression device 400 which may be arranged at the lower end of the casing 100 may have a variable capacity.

The first compression device 300 may include a first cylinder 310 having a ring shape and installed in the casing 100, and an upper bearing plate 320 (hereafter, referred to as "upper beating") and a middle bearing plate 330 (hereafter, referred to as "middle bearing") covering upper and lower sides of the first cylinder 310, thereby forming a first compression space V1, that supports the rotational shaft 230 in a radial direction. The first rolling piston 340 may be rotatably coupled to an upper eccentric portion of the rotational shaft 230 and compresses the refrigerant by orbiting in the first compression space V1 of the first cylinder 310. A first vane 350 may be coupled to the first cylinder 310 to be movable in a radial direction so as to be in contact with an outer circumferential surface of the first rolling piston 340 that divides the first compression space V1 of the first cylinder 310 into a first suction chamber and a first compression chamber. A vane supporting spring 360, which may be formed of a compression spring, may elastically support a rear side of the first vane 350. A first discharge valve 370 may be openably coupled to an end of a first discharge opening 321 disposed in a middle of the upper bearing 320 to control a discharge of a refrigerant gas discharged from the first compression chamber of the first compression space V1. Also, a first muffler 380 may be coupled to the upper bearing 320 and may have an inner volume to receive the first discharge valve 370.

The first cylinder 310, as shown in FIG. 5, may include a first vane slot 311 formed at one side of an inner circumferential surface thereof constituting the first compression space V1 for reciprocating the first vane 350 in a radial direction, a first inlet (not shown) formed at one side of the first vane slot 311 in a radial direction that introduces a refrigerant into the first compression space V1, and a first discharge guiding groove (not shown) inclinably installed at the other side of the first vane slot 311 in a shaft direction that discharges a refrigerant into the casing 100. One of the upper bearing 320 and the middle bearing 330 may have a diameter shorter than that of the first cylinder 310 such that an outer end (or 'rear end' equally used hereinafter) of the first vane 350 may be supported by a discharge pressure of a refrigerant filled in the hermetic space of the casing 100.

The second compression device 400 may include a second cylinder 410 having a ring shape and installed at a lower side of the first cylinder 310 inside the casing 100, and the middle bearing 330 and a lower bearing 420 covering both upper and lower sides of the second cylinder 410 to thereby form a second compression space V2, that support the rotational shaft 230 in a radial direction and a shaft direction. A second rolling piston 430 may be rotatably coupled to a lower eccentric portion of the rotational shaft 230 to compress a refrigerant by orbiting in the second compression space V2 of the second cylinder 410. A second vane 440 may be movably coupled to the second cylinder 410 in a radial direction so as to be in contact with or be spaced apart from an outer circumferential surface of the second rolling piston 430, to divide the second compression space V2 of the second cylinder 410 into a second suction chamber and a second compression chamber or that connects the second suction chamber to the second compression chamber. A second discharge valve 450 may be openably coupled to an end of a second discharge opening 421 provided in the middle of the lower bearing 420 to control a discharge of a refrigerant discharged from the second compression chamber. A second muffler 460 may be coupled to the lower bearing 420 and may have a certain inner volume to receive the second discharge valve 450.

The second compression space V2 of the second cylinder 410 may have the same or a different capacity from the first compression space V1 of the first cylinder 310, if necessary. For example, where the two cylinders 310 and 410 have the same capacity, when the second cylinder 410 is driven in a saving driving mode, the compressor may be driven with a capacity corresponding to the capacity of another cylinder (for example, the first cylinder 310), and thus, a function of the compressor may be varied up to 50%. On the other hand, where the two cylinders 310 and 410 have different capacities, the function of the compressor may be varied into a ratio corresponding to a capacity of a cylinder that performs power driving.

The second cylinder 410, as shown in FIGS. 5 to 7, may include a second vane slot 411 formed at one side of an inner circumferential surface thereof constituting the second compression space V2 that allows the second vane 440 to reciprocate in a radial direction, a second inlet 412 formed at one side of the second vane slot 411 in a radial direction that introduces a refrigerant into the second compression space V2, and a second discharge guiding groove (not shown) inclinably formed at the other side of the second vane slot 411 in a shaft direction that discharges a refrigerant into the casing 100. Also, a vane chamber 413 may be hermetically formed at a rear side of the second vane slot 411, and may be connected to a common side connection pipe 530 of a mode switching device 500 to be explained later. The vane chamber 413 may also be separated from the hermetic space of the casing 100 so as to maintain the rear side of the second vane 440 as a suction pressure atmosphere or a discharge pressure atmosphere. A high pressure passage 414 that connects the inside of the casing 100 to the second vane slot 411 in a perpendicular direction or an inclined direction to a motion direction of the second vane 440 and thereby restricts the second vane 440 by a discharge pressure inside the casing 100 is formed at the second cylinder 440. A low pressure passage 415 that connects the second vane slot 411 to the second inlet 412 to generate a pressure difference with the high pressure passage 414 so as to quickly restrict the second vane 440 may be formed at an opposite side to the high pressure passage 414.

The vane chamber 413 connected to the common side connection pipe 530 to be explained later may have a certain inner volume. Accordingly, even if the second vane 440 has been completely moved backward so as to be received inside the second vane slot 411, the rear surface of the second vane 440 may have a pressure surface for a pressure supplied through the common side connection pipe 530. The high pressure passage 414, as shown in FIGS. 5 and 6, may be positioned at a side of the discharge guiding groove (not shown) of the second cylinder 410 based on the second vane 440, and may be penetratingly formed toward a center of the second vane slot 411 from an outer circumferential surface of the second cylinder 410.

The high pressure passage 414 may be formed to have a two-step narrowly formed towards the second vane slot 411 using a two-step drill. An outlet of the high pressure passage 414 may be formed at an approximate middle part of the second vane slot 411 in a longitudinal direction so that the second vane 440 may perform a stable linear reciprocation. A sectional area of the high pressure passage 414 may be equal to or narrower than a pressure surface applied to a rear surface of the second vane 440 via the vane chamber, that is, a sectional area of the second vane slot 411, thereby preventing the second vane 440 from being excessively restricted.

Although not shown in the drawings, the high pressure passage 414 may be recessed a certain depth in both upper and lower side surfaces of the second cylinder 410, or may be recessed by a certain depth in the lower bearing 420 or the middle bearing 330, respectively, coupled to both side surfaces of the second cylinder 410 or formed through the lower bearing 420 or the middle bearing 330. If the high pressure passage 414 is recessed at an upper surface either of the lower bearing 420 or of the middle bearing 330, it may be formed at the same time that the second cylinder 410 or each bearing 420 and 330 is processed, for example, by sintering, to reduce fabrication cost.

The low pressure passage 415 may be arranged on the same line with the high pressure passage 414 such that a pressure difference between a discharge pressure and a suction pressure may be generated at both side surfaces of the second vane 440, thereby allowing the second vane 440 to come in contact with the second vane slot 411. However, the low pressure passage 415 may be formed on a parallel line with the high pressure passage 414 or at an angle thereto so as to be crossed with the high pressure passage 414.

The low pressure passage 415, as shown in FIG. 8, may be positioned to be connected to the vane chamber 413 by a gap between the second vane 440 and the second vane slot 411 when the compressor is in a saving driving mode. However, if the second vane 440 is moved forward while the compressor is in a power driving mode, when the low pressure passage 415 is connected to the vane chamber 413, a discharge pressure Pd filled in the vane chamber 413 may be leaked to the second inlet 412 into which a refrigerant of a suction pressure is introduced. Accordingly, the second vane 440 may not be satisfactorily supported. Hence, the low pressure passage 415 may be formed to be positioned within a reciprocating range of the second vane 440.

Although not shown in the drawings, a plurality of each of the high pressure passage 414 and the low pressure passage 415 may be formed along a height direction of the second vane 440. The sectional areas of the high pressure passage 414 and the low pressure passage 415 may be the same or different.

The mode switching device 500 may include a low pressure side connection pipe 510 diverged from a second gas suction pipe SP2, a high pressure side connection pipe 520 connected into an inner space of the casing 100, a common side connection pipe 530 connected to the vane chamber 413 of the second cylinder 410 and alternately connected to both the low pressure side connection pipe 510 and the high pressure side connection pipe 520, a first mode switching valve 540 connected to the vane chamber 413 of the second cylinder 410 via the common side connection pipe 530, and a second mode switching valve 550 connected to the first mode switching valve 540 that controls an opening/closing operation of the first mode switching valve 540. The low pressure side connection pipe 510 may be connected between a suction side of the second cylinder 410 and an inlet side gas suction pipe of an accumulator 110, or between the suction side of the second cylinder 410 and an outlet side gas suction pipe (second gas suction pipe SP2).

The high pressure side connection pipe 520 may be connected to a lower portion of the casing 100, thereby to directly introduce oil within the casing 100 into the vane chamber 413, or may be diverged from a middle part of a gas discharge pipe DP. Herein, as the vane chamber 413 becomes hermetic, oil may not be supplied between the second vane 440 and the second vane slot 411, which may generate a frictional loss. Accordingly, an oil supply hole (not shown) may be formed at the lower bearing 420 such that the oil may be supplied when the second vane 440 performs a reciprocating motion.

An operational of a double type variable capacity rotary compressor according to an embodiment disclosed herein will be described as follows.

That is, when the rotor 220 is rotated as power is applied to the stator 210 of the motor 200, the rotational shaft 230 is rotated together with the rotor 220. A rotational force of the motor 200 is transferred to the first compression device 300 and the second compression device 400. Depending on a capacitance of an air conditioner, both the first and second compression devices 300 and 400 may be normally driven (for example, in a power driving mode) so as to generate a cooling capacity of a large capacitance, or the first compression device 300 may perform a normal driving and the second compression device 400 may perform a saving driving, so as to generate a cooling capacity of a small capacitance.

In the case where the compressor or an air conditioner having the same is in a power driving mode, as shown in FIG. 5, power is applied to the second mode switching valve 550. Accordingly, the low pressure side connection pipe 510 may be blocked while the high pressure side connection pipe 520 is connected to the common side connection pipe 530. Gas of high pressure or oil of high pressure within the casing 100 may be supplied to the vane chamber 413 of the second cylinder 410 via the high pressure side connection pipe 520, and thereby the second vane 440 may be retreated by a pressure of the vane chamber 413. As a result, the second vane 440 may be maintained in a state of being in contact with the second rolling piston 430 and normally compresses refrigerant gas introduced into the second compression space V2 and then discharges the compressed refrigerant gas.

At this time, a refrigerant or oil of high pressure may be supplied into the high pressure passage 414 formed in the second cylinder 410 or the bearing 330 or 420, to thereby pressurize one side surface of the second vane 440. However, since the sectional area of the high pressure passage 414 is smaller than that of the second vane slot 411, a pressurizing force of the vane chamber 413 in a lateral direction may be smaller that a pressurizing force of the vane chamber 413 in backward and forward directions. As a result, the second vane 440 may not be restricted.

As such, the first vane 350 and the second vane 440 may be respectively in contact with the rolling pistons 340 and 440, to thereby divide the first compression space V1 and the second compression space V2 into a suction chamber and a compression chamber. As the first vane 310 and the second vane 440 compress each refrigerant sucked into each suction chamber and then discharge the compressed refrigerant. As a result, the compressor or the air conditioner having the same may perform a driving of 100%.

On the other hand, when the compressor or an air conditioner having the same is in a saving driving mode, as shown in FIG. 7, the mode switching device 500 may be operated in an opposite way to the normal (power) driving, to thereby connect the low pressure side connection pipe 510 to the common side connection pipe 530. As a result, a refrigerant of a low pressure sucked into the second cylinder 410 may be partially introduced into the vane chamber 413. Accordingly, the second vane 440 may be retreated by a pressure of the second compression space V2 to be received inside the second vane slot 411, and thus, the suction chamber and the compression chamber of the second compression space V2 may be connected to each other. Thus, the refrigerant sucked into the second compression space V2 may not be compressed.

Here, a pressure difference applied onto both side surfaces of the second vane 440 may be increased by the high pressure passage 414 and the low pressure passage 415 formed in the second cylinder 410 or the bearing 330 or 420. Accordingly, the second vane 440 may be efficiently and rapidly restricted. For example, as shown in FIGS. 7 and 8, oil or refrigerant at the high pressure may be introduced into the high pressure passage 414 and simultaneously refrigerant or oil at a discharge pressure remaining in the vane chamber 413 may be leaked into a gap between the second vane 440 and the vane slot 411 and to the second inlet 412 through the low pressure passage 415. Accordingly, when the operation mode of the compressor is switched, the second vane 440 may be restricted more rapidly. In particular, when the compressor is switched from the power driving mode into the saving driving mode, if a discharge pressure Pd filled in the vane chamber 413 is not quickly discharged therefrom, a restriction force F2 transferred to the second vane 440 via the high pressure passage 414 may not be much greater than a supporting force F1 transferred to the second vane 440 from the vane chamber 413 which may have a relatively large pressurized area due to the small sectional area of the high pressure passage 414, thereby making the second vane move unstably. However, if the low pressure passage 415 connected to the second inlet 412 is formed at the opposite side to the high pressure passage 414, the discharge pressure Pd remaining in the vane chamber 413 may be changed into a middle pressure Pm and then rapidly leaked through the low pressure passage 415. Accordingly, the supporting force F1 at the vane chamber 413 may be drastically decreased, so as to allow the second vane 440 to be rapidly restricted.

Test results are shown in FIG. 9. That is, it can be noted from FIG. 9 that no peak noise, which was generated for approximately 2.5 seconds when the power driving mode is switched to the driving saving mode, as shown in FIG. 4, is generated.

As such, as the compression chamber and the suction chamber of the second cylinder 410 are connected to each other, refrigerant sucked into the suction chamber of the second cylinder 410 may not be compressed but rather removed into the suction chamber along a locus of the second rolling piston 430. Accordingly, the second compression device 400 may not compress the refrigerant, and thus the compressor or the air conditioner having the same performs a driving corresponding to only the capacity of the first compression device 300.

The vane restricting method according to embodiments disclosed herein may be applied to another variable capacity rotary compressor. That is, in the aforementioned embodiment, in the case of supplying a refrigerant at a suction pressure Ps into the inlet 412 at any time regardless of the operation mode of the compressor, the vane chamber 413 may be connected to the inlet 412, so that the discharge pressure Pd of the vane chamber 413 may be rapidly leaked to the inlet 412 when the power driving mode is switched into the saving driving mode. However, in the embodiments shown in FIGS. 10 and 11, a refrigerant switching valve 600 may be further provided at a gas suction pipe (not shown) connected to the inlet 412 such that a refrigerant of the suction pressure Ps or the discharge pressure Pd may selectively be supplied to the inlet 412 depending on the operation mode. With this configuration, at the time of the saving driving mode, the refrigerant of the discharge pressure Pd may be introduced into the second compression space V2 of the second cylinder 410 via the inlet 412, and thereby the second vane 440 may be retreated to be restricted accordingly.

Figure 10:
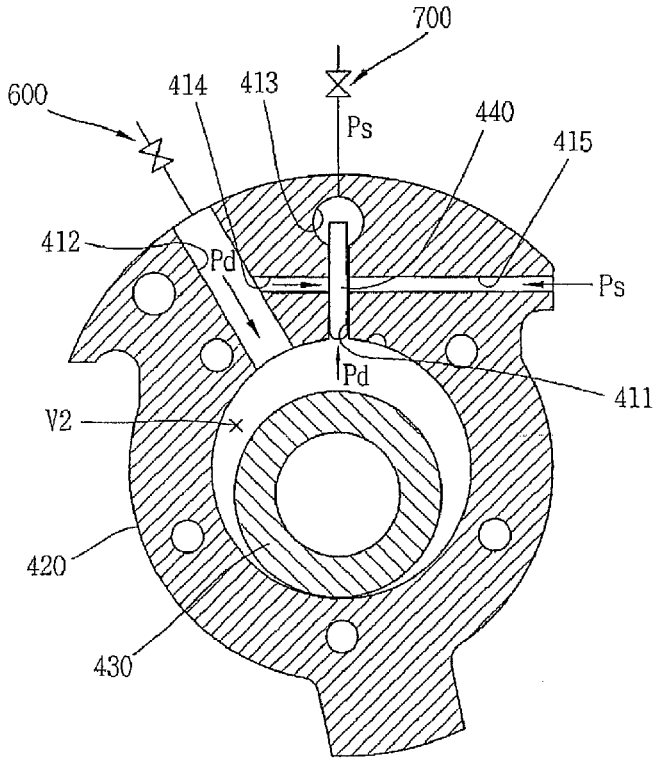
FIGS. 10 and 11 are horizontal sectional views each showing a variable capacity rotary compressor according to another embodiment.
Figure 11:
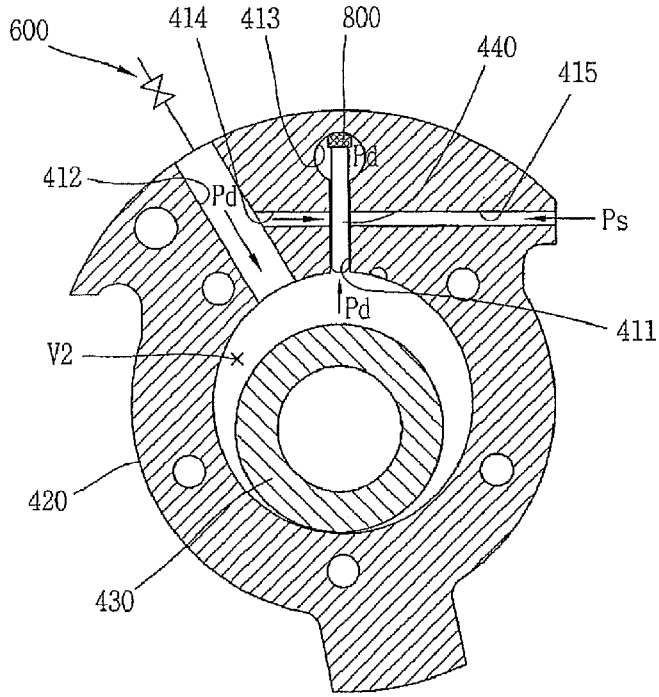

In this case, as shown in FIG. 10, it may be implemented that either the discharge pressure Pd or the suction pressure Ps may selectively be supplied to the rear side of the second vane 440 depending on the operation mode of the compressor. In the alternative, as shown in FIG. 11, it may be implemented that the discharge pressure Pd may always be supplied to the rear side of the second vane 440.

For example, in the embodiment of FIG. 10, a vane chamber 413 separated from the hermetic space of the casing 100 may be formed at the rear side of the second vane 440, and a back pressure switching valve 700 that selectively supplies either a suction pressure or a discharge pressure according to the operation mode of the compressor may be connected to the vane chamber 413. Also, in the embodiment of FIG. 11, the hermetic space of the casing 100 may be connected to an outer surface of the second vane slot 411, and a vane restricting device 800, such as a magnet or a tensile spring, may be disposed at an outer circumferential surface of the second vane slot 411.

Even in the above embodiments, the high pressure passage 414 and the low pressure passage 415 may be connected to both sides of the second vane slot 411. Accordingly, at the time of the saving driving mode, the second vane 440 may be effectively restricted by a pressure difference between the high pressure passage 414 and the low pressure passage 415. However, in these embodiments, at the time of the saving driving mode, since the refrigerant of the discharge pressure Pd may be introduced via the second inlet 412, the high pressure passage 414, unlike in the aforementioned embodiment, may be formed between the second inlet 412 and the second vane slot 411, while the low pressure passage 415 may be formed to be connected to a suction pressure side connection pipe (not shown) provided at an outer surface of the casing 100 from the opposite side to the high pressure passage 414.

An exemplary double type rotary compressor has been described according to the embodiments disclosed herein, but embodiments may equally be applied to a single type rotary compressor. Also, it may equally be applied to every compression device of the double type rotary compressor, explanations all of which are similar to those of the aforementioned embodiments, and thus are not repeated herein.

Figure 12:
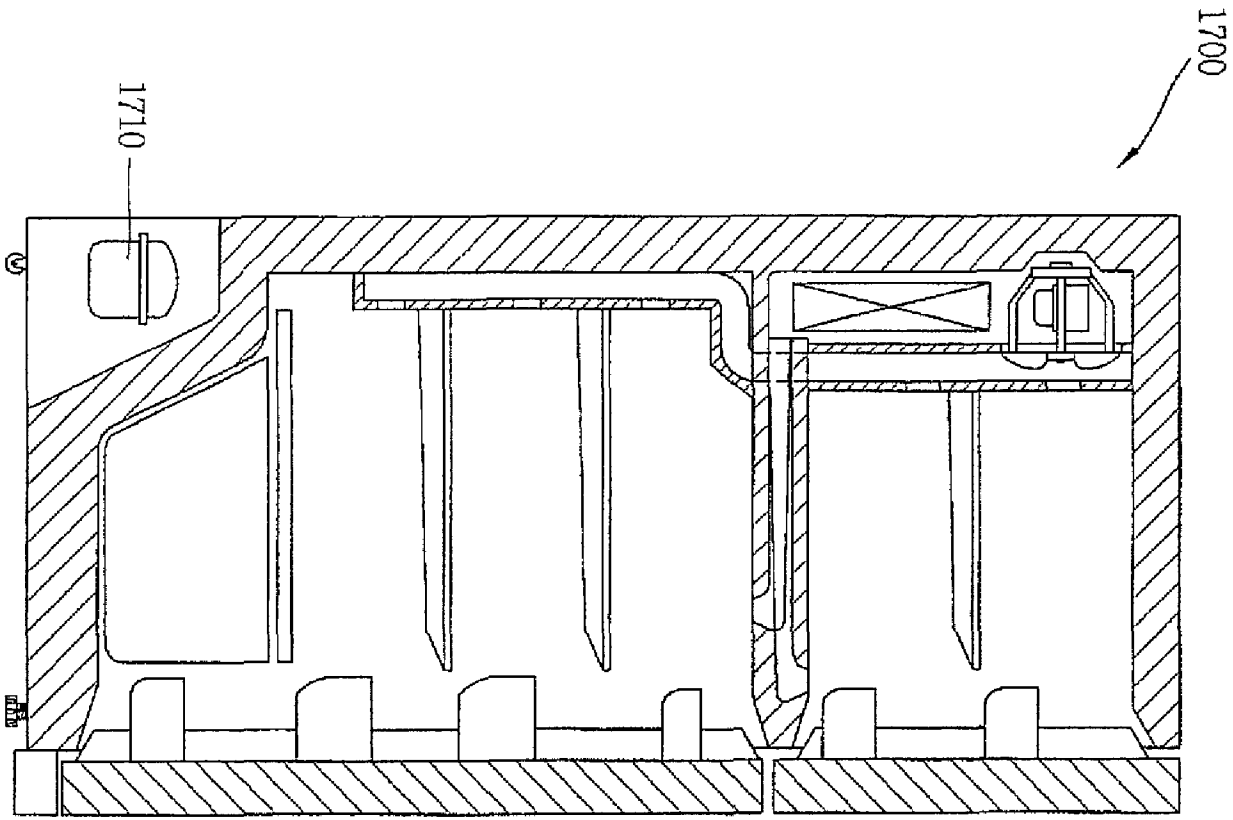
FIGS. 12-14 are exemplary installations of a variable capacity rotary according to embodiments.

A variable capacity rotary compressor according to embodiments disclosed herein has numerous applications in which compression of fluid is required. Such application may include, for example, air conditioning and refrigeration applications. One such exemplary application is shown in FIG. 12, in which, a compressor 1710 according to embodiments disclosed herein is installed in a refrigerator/freezer 1700. Installation and functionality of a compressor in a refrigerator is discussed in detail in U.S. Pat. Nos. 7,082,776, 6,955,064, 7,114,345, 7,055,338, and 6,772,601, the entirety of which are incorporated herein by reference.

Figure 13:
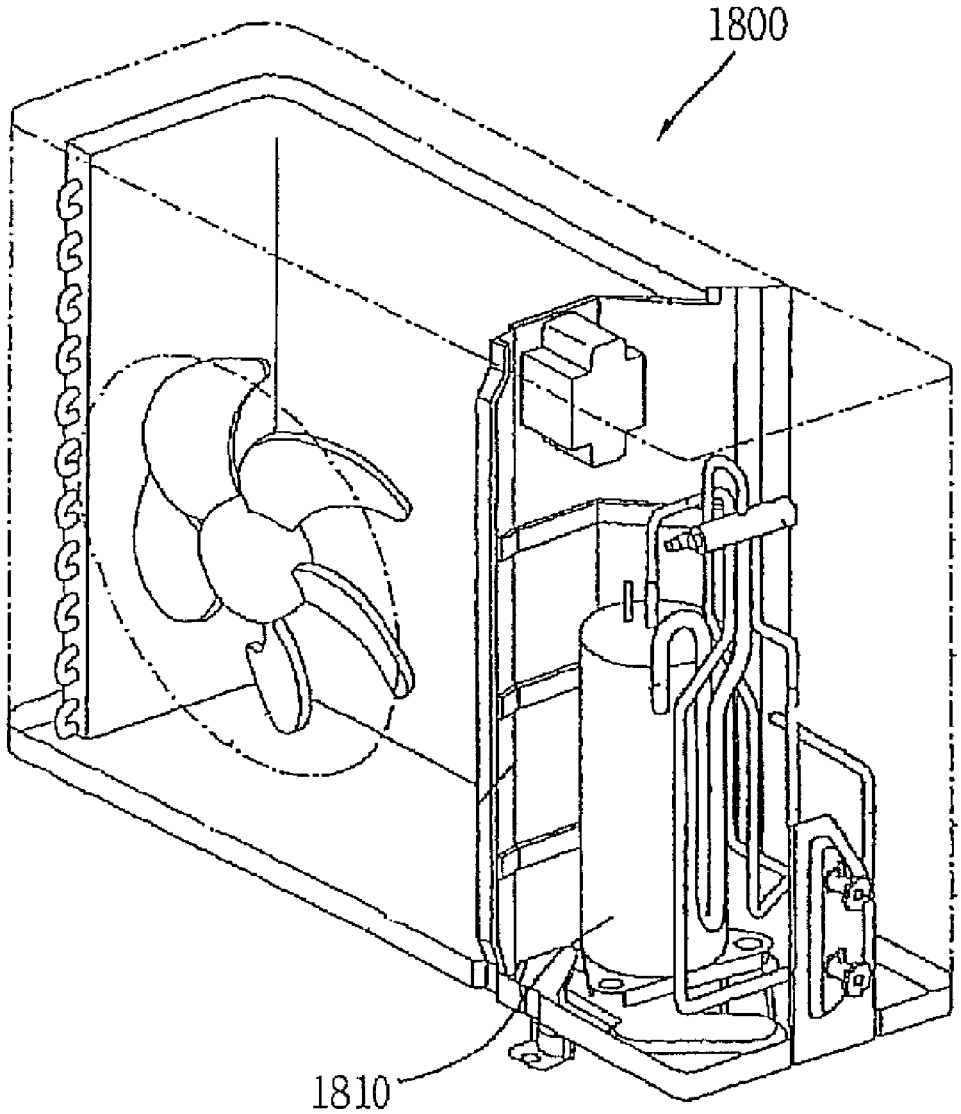

Another such exemplary application is shown in FIG. 13, in which a compressor 1810 according to embodiments disclosed herein is installed in an outdoor unit of an air conditioner 1800. Installation and functionality of a compressor in a refrigerator is discussed in detail in U.S. Pat. Nos. 7,121, 106, 6,868,681, 5,775,120, 6,374,492, 6,962,058, and 5,947, 373, the entirety of which are incorporated herein by reference.

Figure 14:
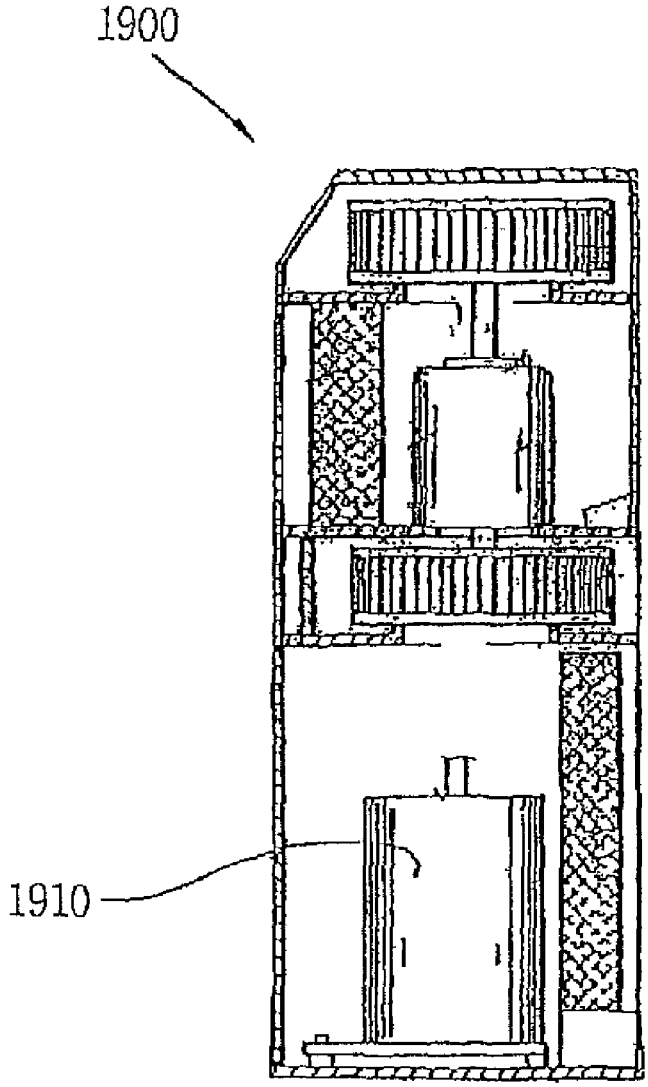

Another such exemplary application is shown in FIG. 14, in which a compressor 1910 according to embodiments disclosed herein is installed in a single, integrated air conditioning unit 1900. Installation and functionality of a compressor in a refrigerator is discussed in detail in U.S. Pat. Nos. 7,032, 404, 6,412,298, 7,036,331, 6,588,228, 6,182,460, and 5,775, 123, the entireties of which is incorporated herein by reference.

Embodiments disclosed herein provide a variable capacity rotary compressor capable of greatly reducing noise due to an impact between a vane and a rolling piston by rapidly restricting the vane at a time of switching a compressor mode.

According to embodiments disclosed herein, as embodied and broadly described herein, there is provided a capacity-variable rotary compressor in which a rolling piston performs an eccentric orbiting motion in an inner space of a hermetic cylinder assembly, a vane performs a linear movement in a radial direction by contacting the rolling piston thereby to divide the inner space into a compression chamber and a suction chamber, and then the vane is restricted by a difference of pressure applied thereto at a time of a saving driving.

According to embodiments disclosed herein, there is also provided a capacity-variable rotary compressor that includes a cylinder assembly installed in a hermetic casing and including a compression space in which a refrigerant is sucked to be compressed, an inlet connected to the compression space, and a vane slot formed at one side of the inlet, a rolling piston for transferring the refrigerant with performing an eccentric orbiting motion inside the compression space of the cylinder assembly, a vane slidibly inserted into the vane slot of the cylinder assembly, having an inner end coming in contact with the rolling piston so as to divide the compression space into a suction chamber and a compression chamber, and a mode switching unit for contacting or separating the vane with/from the rolling piston depending on an operation mode of the compressor, wherein a suction pressure is applied onto one side surface of the vane and a discharge pressure is applied onto the other side of the vane such that the vane can be in contact with the vane slot to thusly be restricted when the compressor performs a saving driving.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A variable capacity rotary compressor, comprising:

a cylinder assembly;

a rolling piston that performs an eccentric orbiting motion inside an inner space of the cylinder assembly;

a vane that performs a linear movement in a radial direction of the rolling piston to control the rolling piston, thereby dividing the inner space into a compression chamber and a suction chamber; and a vane restricting mechanism configured to restrict the vane by applying a pressure difference directly to side surfaces of the vane, wherein the side surfaces of the vane extend in a perpendicular direction or an inclined direction with respect to a direction of motion of the vane, wherein vane restricting mechanism is configured to restrict the vane by withdrawing the vane into a vane slot formed in a cylinder of the cylinder assembly, and wherein the vane restricting mechanist composes at least one high pressure passage and at least one low pressure passage in communication with the vane slot.

2. The compressor of claim 1, wherein the vane restricting mechanism is configured to restrict the vane by applying the pressure difference to the side surfaces of the vane at a time of switching to a saving driving mode.

3. The compressor of claim 1, wherein the vane restricting mechanism is configured to restrict the vane by applying a suction pressure and a discharge pressure in the direction crossing the direction of motion of the vane.

4. The compressor of claim 3, wherein the suction pressure and the discharge pressure are selectively supplied to a rear side of the vane according to an operation mode of the compressor.

5. The compressor of claim 4, wherein a connection passage is formed such that a pressure at the rear side of the vane communicates with a pressure applied in a direction crossing the pressure at the rear side of the vane.

6. The compressor of claim 4, wherein a connection passage is formed such that a pressure at the rear side of the vane communicates with a pressure applied in a direction substantially perpendicular to the pressure at the rear side of the vane.

7. The compressor of claim 3, wherein the suction pressure and the discharge pressure are selectively supplied into the inner space of the cylinder assembly according to an operation mode of the compressor.

8. The compressor of claim 7, wherein the discharge pressure supplied into the inner space of the cylinder assembly is applied to the vane in a direction crossing the direction of motion of the vane when the compressor is in a saving driving mode, and the suction pressure is applied to the vane in an opposite direction thereto.

9. The compressor of claim 1, wherein the vane restricting mechanism is configured to restrict the vane by applying a suction pressure and a discharge pressure in a direction substantially perpendicular to the direction of motion of the vane.

10. The compressor of claim 1, wherein the at least one high pressure passage connects the vane slot to an inside of a casing of the compressor, and the at least one low pressure passage connects the vane slot to an inlet formed in the cylinder assembly.

11. The compressor of claim 1, wherein the at least one high pressure passage is formed at a substantially middle portion of the vane slot.

12. The compressor of claim 1, wherein a cross-sectional area of the at least one high pressure passage is equal to or less than a cross-sectional area of the vane slot.

13. The compressor of claim 1, wherein the at least one high pressure passage and the at least one low pressure passage extend along the same line.

14. The compressor of claim 1, further comprising a vane chamber formed at a rear portion of the vane slot.

15. The compressor of claim 14, wherein a gap is provided between the vane and the vane slot when the vane is in the withdrawn position, such that the at least one low pressure passage communicates with the vane chamber via the gap.

16. The compressor of claim 14, further comprising a mode switching device in communication with the vane chamber.

17. The compressor of claim 14, further comprising a vane restricting device in the vane chamber.

18. The compressor of claim 17, wherein the vane restricting device comprises one of a magnet or tensile spring.

19. The compressor of claim 14, further comprising a back pressure switching valve in communication with the vane chamber.

20. The compressor of claim 1, wherein the at least one high pressure passage and the at least one low pressure passage comprise a plurality of high and low pressure passages.

21. A variable capacity rotary compressor, comprising:

a cylinder assembly installed in a casing and including a compression space in which a refrigerant is sucked to be compressed, an inlet connected to the compression space, and a vane slot formed at one side of the inlet;

a rolling piston that compresses a refrigerant by performing an eccentric orbiting motion inside the compression space of the cylinder assembly;

a vane slidibly inserted into the vane slot of the cylinder assembly, and having an inner end configured to contact the rolling piston to divide the compression space into a suction chamber and a compression chamber; and a mode switching device that contacts or separates the vane with or from the rolling piston depending on an operation mode of the compressor, wherein a suction pressure is applied directly onto one side surface of the vane, the one side surface of the vane extending in a perpendicular direction or an inclined direction with respect to a direction of motion of the vane and a discharge pressure is applied directly onto the other side surface of the vane, the other side surface of the vane extending in a perpendicular direction or an inclined direction with respect to the direction of motion of the vane to separate the vane from the rolling piston and withdraw the vane into the vane slot.

22. The compressor of claim 21, wherein the suction pressure is applied onto the one side surface of the vane and the discharge pressure is applied onto the other side of the vane to separate the vane from the rolling piston and withdraw the vane into the vane slot when the compressor performs a saving driving operation.

23. The compressor of claim 21, wherein the inlet is connected to a gas suction pipe to supply a refrigerant at the suction pressure therethrough.

24. The compressor of claim 21, wherein the cylinder assembly comprises at least one high pressure passage that connects the inside of the casing to the vane slot, and at least one low pressure passage that connects the vane slot to the inlet.

25. The compressor of claim 24, wherein the at least one high pressure passage and the at least one low pressure passage are positioned within a reciprocating range of the vane.

26. The compressor of claim 24, wherein the at least one high pressure passage has a cross-sectional area greater than or the same as a sectional area of the at least one low pressure passage.

27. The compressor of claim 21, wherein the mode switching device comprises:

a vane chamber connected to an outer end of the vane slot and separated from an inner space of the casing; and a back pressure switching device connected to the vane chamber to selectively supply either the suction pressure or the discharge pressure to the vane chamber according to the operation mode of the compressor.

28. The compressor of claim 27, wherein the mode switching device further comprises:

a refrigerant switching device connected to the inlet of the cylinder assembly to selectively supply a refrigerant at a suction pressure or a discharge pressure to the compression space of the cylinder assembly according to the operation mode of the compressor.

29. The compressor of claim 21, wherein the cylinder assembly comprises a cylinder having a ring shape and a plurality of bearings disposed at upper and lower sides of the cylinder to form the inner space, and wherein the cylinder comprises at least one low pressure passage that connects the vane slot and the inlet, and at least one high pressure passage connected to the vane slot and formed at an opposite side to the low pressure passage.

30. The compressor of claim 21, wherein the cylinder assembly comprises a cylinder having a ring shape and a plurality of bearings disposed at upper and lower sides of the cylinder to form the inner space, and wherein the cylinder comprises at least one low pressure passage that connects the vane slot and the inlet, and at least one high pressure passage connected to the vane slot and formed at one of the plurality of bearings.

31. The compressor of claim 21, wherein the inlet is connected to the compression space and a refrigerant at a suction pressure or a discharge pressure is selectively supplied therethrough according to an operation mode of the compressor.

32. The compressor of claim 31, wherein the cylinder assembly comprises at least one low pressure passage to apply the suction pressure to the one side surface of the vane, and at least one high pressure passage that connects the vane slot to the inlet, to apply the discharge pressure to the other side surface of the vane.

33. The compressor of claim 32, wherein the at least one high pressure passage and the at least one low pressure passage are positioned within a reciprocating range of the vane.

34. The compressor of claim 32, wherein the cylinder assembly comprises a cylinder having a ring shape and a plurality of bearings disposed at upper and lower sides of the cylinder forming the compression space, and wherein the cylinder comprises the at least one high pressure passage, which is formed between the vane slot and the inlet, and the at least one low pressure passage, which is connected to the vane slot and formed at an opposite side to the at least one high pressure passage.

35. The compressor of claim 32, wherein the cylinder assembly comprises a cylinder having a ring shape and a plurality of bearings disposed at upper and lower sides of the cylinder to forming the compression space, and wherein the cylinder comprises the at least one high pressure passage, which is formed between the vane slot and the inlet, and the at least one low pressure passage, which is connected to the vane slot and formed at one of the plurality of bearings.

36. The compressor of claim 21, wherein the mode switching device comprises:

a refrigerant switching device connected to the inlet of the cylinder assembly to selectively supply a refrigerant at a suction pressure or a discharge pressure to the compression space of the cylinder assembly according to the operation mode of the compressor; and a vane restricting device disposed at an outer end of the vane slot connected to the space of the inner casing to restrict the vane.

37. The compressor of claim 21, further comprising at least one high pressure passage and at least one low pressure passage in communication with the vane slot.

38. The compressor of claim 37, wherein the at least one high pressure passage connects the vane slot to an inner space of the casing, and the at least one low pressure passage connects the vane slot to the inlet formed.

39. The compressor of claim 37, wherein the at least one high pressure passage is formed at a substantially middle portion of the vane slot.

40. The compressor of claim 37, wherein a cross-sectional area of the at least one high pressure passage is equal to or less than a cross-sectional area of the vane slot.

41. The compressor of claim 37, wherein the at least one high pressure passage and the at least one low pressure passage extend along the same line.

42. The compressor of claim 37, further comprising a vane chamber formed at a rear portion of the vane slot.

43. The compressor of claim 42, wherein a gap is provided between the vane and the vane slot when the vane is in the withdrawn position, such that the at least one low pressure passage communicates with the vane chamber via the gap.

44. The compressor of claim 42, wherein the mode switching device is in communication with the vane chamber.

45. The compressor of claim 42, further comprising a vane restricting device in the vane chamber.

46. The compressor of claim 45, wherein the vane restricting device comprises one of a magnet or tensile spring.

47. The compressor of claim 42, further comprising a back pressure switching valve in communication with the vane chamber.

48. The compressor of claim 37, wherein the at least one high pressure passage and the at least one low pressure passage comprise a plurality of high and low pressure passages.

49. A variable capacity rotary compressor, comprising:

a cylinder assembly;

a rolling piston that performs an eccentric orbiting motion inside an inner space of the cylinder assembly;

a vane that performs a linear movement in a radial direction of the rolling piston to control the rolling piston, thereby dividing the inner space into a compression chamber and a suction chamber; and a vane restricting mechanism configured to restrict the vane by applying a pressure difference directly to side surfaces of the vane, wherein the side surfaces of the vane extend in a perpendicular direction or an inclined direction with respect to a direction of motion of the vane, and wherein the vane restricting mechanism is configured to restrict the vane by applying a suction pressure and a discharge pressure in a direction crossing the direction of motion of the vane.

50. The compressor of claim 49, wherein the suction pressure and the discharge pressure are selectively supplied to a rear side of the vane according to an operation mode of the compressor.

51. The compressor of claim 50, wherein a connection passage is formed such that a pressure at the rear side of the vane communicates with a pressure applied in a direction crossing the pressure at the rear side of the vane.

52. The compressor of claim 50, wherein a connection passage is formed such that a pressure at the rear side of the vane communicates with a pressure applied in a direction substantially perpendicular to the pressure at the rear side of the vane.

53. The compressor of claim 49, wherein the suction pressure and the discharge pressure are selectively supplied into the inner space of the cylinder assembly according to an operation mode of the compressor.

54. The compressor of claim 53, wherein the discharge pressure supplied into the inner space of the cylinder assembly is applied to the vane in the direction crossing the direction of motion of the vane when the compressor is in a saving driving mode, and the suction pressure is applied to the vane in an opposite direction thereto.

55. A variable capacity rotary compressor, comprising:

a cylinder assembly;

a rolling piston that performs an eccentric orbiting motion inside an inner space of the cylinder assembly;

a vane that performs a linear movement in a radial direction of the rolling piston to control the rolling piston, thereby dividing the inner space into a compression chamber and a suction chamber; and a vane restricting mechanism configured to restrict the vane by applying a pressure difference directly to side surfaces of the vane, wherein the side surfaces of the vane extend in a perpendicular direction or an inclined direction with respect to a direction of motion of the vane, and wherein the vane restricting mechanism is configured to restrict the vane by applying a suction pressure and a discharge pressure in a direction substantially perpendicular to the direction of motion of the vane.

* * * * *